US009084453B2

(12) United States Patent
Yagyu

(10) Patent No.: US 9,084,453 B2
(45) Date of Patent: Jul. 21, 2015

(54) WOVEN FASTENER STRINGER AND SLIDE FASTENER

(75) Inventor: Akihiro Yagyu, Toyama (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 14/349,848

(22) PCT Filed: Oct. 6, 2011

(86) PCT No.: PCT/JP2011/073078

§ 371 (c)(1),
(2), (4) Date: Apr. 4, 2014

(87) PCT Pub. No.: WO2013/051127

PCT Pub. Date: Apr. 11, 2013

(65) Prior Publication Data

US 2014/0237778 A1 Aug. 28, 2014

(51) Int. Cl.
*A44B 19/34* (2006.01)
*A44B 19/54* (2006.01)

(52) U.S. Cl.
CPC ..... *A44B 19/346* (2013.01); *A44B 19/54* (2013.01); *Y10T 24/25* (2015.01)

(58) Field of Classification Search
CPC ..... A44B 19/346; A44B 19/54; Y10T 24/25
USPC ..... 24/393, 394, 395, 396, 392; 139/384 B
See application file for complete search history.

(56) References Cited

U.S. PATENT DOCUMENTS 3,847,188 A 11/1974 Auer et al.
4,188,982 A * 2/1980 Yoshida et al. ..... 139/384 B
4,191,220 A * 3/1980 Yoshida ..... 139/384 B
4,254,803 A * 3/1981 Tsubata ..... 139/384 B
4,623,004 A * 11/1986 Matsushima et al. ..... 139/384 B
4,915,140 A * 4/1990 Ofusa et al. ..... 139/384 B
5,140,725 A 8/1992 Matsushima
5,251,675 A 10/1993 Frohlich (Continued)

FOREIGN PATENT DOCUMENTS

JP S54-92851 A 7/1979
JP H05-184414 A 7/1993

(Continued)

OTHER PUBLICATIONS

International Search Report, PCT Application No. PCT/JP2011/073078 mailed Dec. 20, 2011.

*Primary Examiner* — Robert J Sandy
*Assistant Examiner* — Rowland Do
(74) *Attorney, Agent, or Firm* — Kilpatrick Townsend & Stockton LLP

(57) ABSTRACT

In a woven fastener stringer, a weft thread is folded back while interlacing with a upper direction converting portion configured by an upper fixing warp thread and a lower direction converting portion configured by a lower fixing warp thread on a side close to engaging head portions of fastener elements. An upper extension portion configured by the upper fixing warp thread is placed in adjacent to a tape main body side of the upper direction converting portion. A lower extension portion configured by the lower fixing warp thread is placed in adjacent to the tape main body side of the lower direction converting portion. According to this, when a slide fastener is used in an inside out manner, it is possible to make it difficult to see the coupled fastener elements.

3 Claims, 6 Drawing Sheets

(56) References Cited

U.S. PATENT DOCUMENTS

| | | | | |
|---|---|---|---|---|
| 5,313,989 | A | 5/1994 | Frohlich | |
| 5,699,592 | A * | 12/1997 | Shimono | 24/432 |
| 2008/0110211 | A1 | 5/2008 | Shimono et al. | |

FOREIGN PATENT DOCUMENTS

| | | | |
|---|---|---|---|
| JP | H07-31687 | Y2 | 7/1995 |
| JP | 2008-119076 | A | 5/2008 |

* cited by examiner

WOVEN FASTENER STRINGER AND SLIDE FASTENER

This application is a national stage application of PCT/JP2011/073078, which is incorporated herein by reference.

TECHNICAL FIELD

The invention relates to a woven fastener stringer and a slide fastener in which a continuous element row is woven into and fixed to an element attaching portion simultaneously when a fastener tape is woven, and more particularly, to a woven fastener stringer and a slide fastener in which when a pair of continuous element rows is coupled to each other in a slide fastener, the continuous element rows are hidden by an element attaching portion when the slide fastener is viewed from a second surface which is opposite from a first surface of a fastener tape into which the continuous element rows are woven so that the continuous element rows cannot easily be seen.

BACKGROUND ART

A woven fastener stringer is configured in such a manner that a coil-shaped or zigzag-shaped continuous element row formed from synthetic resin monofilament is woven and fixed along one side edge of a fastener tape simultaneously when the fastener tape is woven. JP 7-31687Y (Patent Document 1) discloses one example of the slide fastener using such a woven fastener stringer.

According to a woven fastener stringer 51 described in Patent Document 1, as shown in FIG. 10, a continuous element row which is continuous in a form of a coil is woven into and fixed to an element attaching portion 53*a* of a fastener tape 53 such that an engaging head portion 54*a* of each of fastener elements 54 projects outward from a tape side edge of the fastener tape 53 simultaneously when the fastener tape 53 is woven.

The fastener tape 53 includes a tape main body 53*b* and the element attaching portion 53*a* which is placed along one side edge of the tape main body 53*b* and to which continuous element rows are fixed. The tape main body 53*b* is woven using a weft thread 61 and a ground warp thread 62.

The weft thread 61 which is continuously weft-inserted from the tape main body 53*b*, and a plurality of upper fixing warp threads 63 and a plurality of lower fixing warp threads 64 which run in a warp direction on an upper surface side of an upper leg 54*b* and on a lower surface side of a lower leg 54*c* of the fastener element 54 are placed in the element attaching portion 53*a*. In this case, the weft thread 61 of the element attaching portion 53*a* runs on a lower surface side of the lower fixing warp thread 64 along the lower leg 54*c* of the fastener element 54, interlaces with two lower fixing warp threads 64 placed on the side of the engaging head portion 54*a*, and is folded toward the upper leg 54*b*.

Further, the weft thread 61 interlaces with the two upper fixing warp threads 63 placed on the side of the engaging head portion 54*a* and is folded. Then, the weft thread 61 runs on an upper surface side of the upper fixing warp thread 63 along the upper leg 54*b*, and is folded on the side of a connecting portion 54*d* of the fastener element 54 through two upper fixing warp threads 63 and two lower fixing warp threads 64 to be returned to the tape main body 53*b*.

Element fastening warp threads 65 which run in the warp direction while alternately straddling the upper leg 54*b* in the continuous element row, and the lower leg 54*c* and the weft thread 61 which runs along the lower leg 54*c*, and a weft thread fastening warp thread 66 which runs in the warp direction while alternately interlacing the weft thread 61 which runs along the upper leg 54*b* and the weft thread 61 which runs along the lower leg 54*c* are placed in the element attaching portion 53*a*.

According to the woven fastener stringer 51 in Patent Document 1 having such a woven texture, the continuous element row can be fixed to the fastener tape 53 by the element fastening warp thread 65, the weft thread 61 is pulled toward a central portion between the upper and lower legs 54*b* and 54*c* by the weft thread 61, the upper and lower fixing warp threads 63 and 64, and the weft thread fastening warp thread 66, the upper and lower fixing warp threads 63 and 64 are fixed to the upper and lower legs 54*b* and 54*c* of the fastener elements 54, and the weft thread 61 is intimately fixed to a lower surface of the lower leg 54*c* of the fastener element 54. According to this, there are effects that the continuous element row does not elongate in a length direction of the tape, a pitch of the fastener element 54 is stabilized, and a stable attached attitude of the fastener element 54 can be maintained for a long time.

In addition to a normal type slide fastener in which the fastener element 54 is attached to the element attaching portion 53*a* of the fastener tape 53 in a state where the engaging head portion 54*a* projects from the tape side edge of the fastener tape 53 as in Patent Document 1, a hidden type slide fastener (hereinafter, abbreviated to hidden slide fastener) is known.

The hidden slide fastener is configured such that a fastener element is attached to an element attaching portion such that its engaging head portion is placed on a side of a tape main body of a fastener tape and then, the fastener tape is folded back in a U-shape at a boundary between the tape main body and the element attaching portion, and the engaging head portion is projected outward from the U-shaped folded back portion of the fastener tape.

JP 2008-119076 A (Patent Document 2) discloses such a hidden slide fastener in which a continuous element row is woven into and fixed to an element attaching portion simultaneously when the fastener tape is woven.

As shown in FIG. 11, the hidden slide fastener 71 described in Patent Document 2 includes a pair of left and right woven fastener tapes 72 each including a tape main body 72*a* and an element attaching portion 72*b*, and a coil-shaped continuous element row 73 woven into the element attaching portion 72*b* of each of the fastener tapes 72.

The tape main body 72*a* of the fastener tape 72 is woven using a weft thread 81 and a ground warp thread 82. The element attaching portion 72*b* is composed of the weft thread 81 which is continuously weft-inserted from the tape main body 72*a*, ten lower fixing warp threads 83 which run in the warp direction on the side of a lower surface of a lower leg 74*c* of each of fastener elements 74, four upper fixing warp threads 84 which run in the warp direction on the side of an upper surface of an upper leg 74*b*, four fastening warp threads 85 which run in the warp direction to alternately interlace with the upper and lower legs 74*b* and 74*c* of the continuous element row 73, and a restricting warp thread 86 which runs in the warp direction while alternately interlacing with the weft thread 81 which runs along the upper leg 74*b* and the weft thread 81 which runs along the lower leg 74*c*, and which restricts positions of the upper and lower fixing warp threads 84 and 83 in a weft direction.

Especially in the element attaching portion 72*b* in the hidden slide fastener 71 of Patent Document 2, the two upper fixing warp threads 84 and the six lower fixing warp threads 83 are placed in regions closer to an engaging head portion

74*a* than one of the fastening warp threads 85 which is placed closest to the engaging head portion 74*a*. The upper and lower fixing warp threads 84 and 83 are divided by a restricting warp thread 86, and positions of the upper and lower fixing warp threads 84 and 83 are restricted.

In this case, the two upper fixing warp threads 84 configure an upper direction converting portion 75 which folds the weft thread 81 running along the upper leg 74*b* of the fastener element 74 toward the lower leg 74*c* to convert a direction. In addition, the number of the six lower fixing warp threads 83 located closer to the engaging head portion 74*a* than the fastening warp thread 85 is greater than the number of the upper fixing warp threads 84 located closer to the engaging head portion 74*a* than the fastening warp thread 85, and the lower fixing warp threads 83 are aligned in minute. Therefore, it is possible to prevent positions of the lower fixing warp threads 83 from deviating in the weft direction.

Therefore, according to the hidden slide fastener 71 of Patent Document 2, a position of a U-shaped folded back portion 72*c* which corresponds to a boundary between the tape main body 72*a* and the element attaching portion 72*b* can be brought closer to the engaging head portion 74*a* by the six lower fixing warp threads 83 located closer to the engaging head portion 74*a* than the fastening warp thread 85. Further, it is possible to prevent the U-shaped folded back portions 72*c* of the left and right fastener tapes 72 from separating from each other by placing the six lower fixing warp threads 83 in minute, and it is possible to prevent a gap from generating between the left and right U-shaped folded back portions 72*c*.

According to this, when the left and right continuous element rows 73 are coupled to each other, it is possible to hide the continuous element rows 73 from an outer surface of the hidden slide fastener 71 (fastener surface opposite from a surface on which the continuous element rows 73 are placed) so that the continuous element rows 73 cannot be seen. Further, even if the hidden slide fastener 71 receives a lateral pulling force which tries to pull the left and right fastener tapes 72 outward, it is possible to keep a state where the left and right U-shaped folded back portions 72*c* are in contact with each other, and a concealed state of the hidden slide fastener 71 can stably be maintained.

CITATION LIST

Patent Documents

Patent Document 1: JP 7-31687 Y
Patent Document 2: JP 2008-119076 A

SUMMARY OF INVENTION

Technical Problem

In conventional shoes such as boots, slide fasteners are provided at openings of the shoes so that a user can easily wear and take off the shoes. The slide fastener having the woven fastener stringer 51 as disclosed in Patent Document 1 is frequently used because durability is excellent and thickness is thin so that the slide fastener does not easily come into contact with skin.

In recent years, to prevent an element row of a woven fastener stringer from deteriorating design and presentation of shoes and boots, the slide fastener is frequently used in a so-called inside out manner in which a tape surface (front surface of tape) on a side where the element row is located is oriented toward an inner surface of the shoe and an opposite tape surface (back surface of tape) is oriented toward and attached to an outer surface of the shoe so that the element row is hidden by the fastener tape not to be easily seen.

According to the slide fastener configured using the woven fastener stringer 51 described in Patent Document 1, however, since a gap 55 is formed between tape side edges of facing left and right fastener tapes 53 when the left and right continuous element rows are coupled to each other as shown in FIG. 10, and engaging head portions 54*a* of the fastener elements 54 in a coupled state appears in the back surface of the fastener tape 53 through the gap 55.

Therefore, even if such a woven slide fastener is attached to the shoe in an inside out manner, the coupled left and right fastener elements 54 cannot sufficiently be hidden. Since the fastener element 54 which comes front from between the left and right fastener tapes 53 affects design and presentation of the shoe in some cases, it is desired to improve a woven slide fastener such that it becomes more difficult to see the coupled fastener elements.

In the case of the hidden type woven slide fastener 71 described in Patent Document 2, when the left and right continuous element rows 73 are coupled to each other to close the slide fastener 71, it is possible to hide the fastener element 74 by the fastener tape 72 so that the fastener element 74 cannot be seen from an outer surface.

However, according to the hidden type woven slide fastener 71, since the fastener tape 72 is not folded into U-shape at the boundary between the tape main body 72*a* and the element attaching portion 72*b*, a thickness of the entire slide fastener 71 becomes thick. Hence, when the hidden type woven slide fastener 71 is used for shoes such as boots, the woven slide fastener has a drawback that the fastener element 74 placed on an inner surface side of the shoe easily comes into contact with skin. Further, the hidden type woven slide fastener 71 is not positively used for shoes such as boots because bendability and sliding performance of the slider are poor as compared with a normal type woven slide fastener.

The invention has been accomplished in view of the conventional problems, and it is a specific object of the invention to provide a normal type woven fastener stringer and a slide fastener having the woven fastener stringer capable of making it difficult to see left and right coupled fastener elements by a fastener tape when a slide fastener is used in an inside out manner, capable of preventing an attitude of the fastener element from inclining in a length direction of the tape, and capable of smoothly coupling and separating the fastener elements to and from each other by sliding a slider.

Solution to Problem

To achieve the above object, a woven fastener stringer provided by the invention basically including: a woven fastener tape having a tape main body and an element attaching portion placed along one side edge of the tape main body; and a continuous element row woven into and fixed to the element attaching portion along a length direction of the tape simultaneously when the fastener tape is woven; in which each fastener element configuring the continuous element rows is woven such that an engaging head portion of the fastener element projects outward from a tape side edge of the fastener tape, the element attaching portion includes a weft thread which is continuously weft-inserted from the tape main body, an upper fixing warp thread and a lower fixing warp thread which run in a warp direction on an upper surface of an upper leg and on a lower surface of a lower leg of the fastener element, and fastening warp threads which run in the warp direction while alternately straddling the upper leg and the lower leg in each of the continuous element rows, and the weft thread is folded back by converting a running direction while interlacing with a upper direction converting portion configured by at least the one upper fixing warp thread and a lower direction converting portion configured by at least the one lower fixing warp thread at a location close to the engaging head portion, wherein a upper extension portion configured by at least the one upper fixing warp thread is placed in adjacent to the tape main body side of the upper direction converting portion, and a lower extension portion configured by at least the one lower fixing warp thread is placed in adjacent to the tape main body side of the lower direction converting portion.

In the woven fastener stringer of the invention, it is preferable that a plurality of the upper fixing warp threads and a plurality of the lower fixing warp threads are placed in the upper and lower extension portions respectively.

Also, it is preferable that the element attaching portion includes restricting warp threads which run in the warp direction while alternately interlacing with the weft thread which runs along the upper leg and the weft thread which runs along the lower leg, and which restrict positions of the upper and lower fixing warp threads in a weft direction.

In this case, it is especially preferable that the weft thread includes a vertically running portion which runs in a tape front/back direction between the upper and lower direction converting portions, the upper extension portion is placed between the vertically running portion of the weft thread and the restricting warp thread, and the lower extension portion is placed between adjacent two of the restricting warp threads.

According to the invention, there is provided a slide fastener including a pair of left and right woven fastener stringers having the above-described configuration.

Advantageous Effects of Invention

According to the woven fastener stringer of the invention, in the element attaching portion of the fastener tape, the upper direction converting portion for interlacing the weft thread to convert a running direction of the weft thread and the upper extension portion which is adjacent to the tape main body side of the upper direction converting portion are configured by the upper fixing warp thread which is located on the upper leg side of the fastener element. The lower direction converting portion for interlacing the weft thread to convert a running direction of the weft thread and the lower extension portion which is adjacent to the tape main body side of the lower direction converting portion are configured by the lower fixing warp thread which is located on the lower leg side of the fastener element. In the invention, the lower leg of the fastener element is a leg which is in intimate contact with the tape surface of the fastener tape, and the upper leg is a leg which is separated from the tape surface of the fastener tape.

When the woven slide fastener is used in the inside out manner, to hide the left and right coupled fastener elements by the fastener tape and to make it difficult to see the fastener elements, the inventors achieved to extend the element attaching portion on the side of the lower leg toward the engaging head portion by increasing the number of the lower fixing warp threads located on the engaging head portion more than the number of the fastening warp threads which fasten upper and lower legs of the fastener element.

That is, using the lower fixing warp thread located on the lower leg of the fastener element, the element attaching portion can be widened toward the engaging head portion by providing the lower extension portion on the side of the tape main body of the lower direction converting portion which makes the weft thread interlace and be folded. According to this, when the slide fastener is configured and the left and right fastener elements are coupled to each other, a gap formed between the facing tape side edges of the left and right fastener tapes can be made extremely small and the gap can be filled completely. Therefore, it is possible to make it difficult to see the engaging head portion of the coupled fastener elements from the gap.

However, in the normal type woven fastener stringer, if only the lower extension portion is actually provided as described above and the element attaching portion is widened toward the engaging head portion, there are problems that balance among a fastening force caused by the upper fixing warp thread located on the upper surface of the upper leg of the fastener element which is woven into and fixed to the element attaching portion, a fastening force caused by the lower fixing warp thread which is located on the lower surface of the lower leg, and a tensile force of the weft thread which is twined with the upper and lower fastening warp threads becomes unstable, the lower extension portion moves toward the tape main body, and a desired width cannot be obtained. Further, when a force balance between the fastening force of the upper and lower fastening warp threads and the tensile force of the weft thread is lost, even if the number of threads of the lower extension portion is increased, it is difficult to obtain a desired width because the threads are superposed on each other.

Especially in the case of the normal type woven fastener stringer, since the lower fixing warp thread which configures the lower extension portion is placed on the tape side edge of the fastener tape, a tensile force applied to this lower fixing warp thread is greater than for example that of the lower fixing warp thread which is placed on the central portion of the tape to stabilize the tape mode of the fastener tape. Hence, it was found that since the tensile force of the weft thread which was twined with the lower fixing warp thread located on the side of the engaging head portion of the fastener element became greater than the tensile force of the weft thread which was twined with the upper fixing warp thread located on the side of the engaging head portion, the lower fixing warp thread moved toward the tape main body.

If the lower fixing warp thread moves toward the tape main body in this manner, it is difficult to make it difficult to see the engaging head portion of the fastener element by the lower extension portion. Further, if the number of threads of the lower extension portion is increased more than necessary to make it difficult to see the engaging head portion, the threads are superposed on each other. As a result, there is a problem that physical appearance (quality of outward appearance) is deteriorated, and when the left and right fastener elements are coupled to each other, the superposed portion excessively comes into contact as compared with other portion due to the sliding motion of the slider, and thereby the threads are cut.

Hence, the inventors studied hard to solve this problem that the tensile force is caused by the weft thread simultaneously when the lower extension portion of the fastener tape is extended toward the engaging head portion, and it is difficult to make it difficult to see the engaging head portion of the fastener element. As a result, the inventors found that on the side of the engaging head portion of the element attaching portion, the lower direction converting portion which converts the running direction of the weft thread and the lower extension portion on the tape main body side of the lower direction converting portion are provided using the lower fixing warp thread, and the upper direction converting portion which converts the running direction of the weft thread and the upper extension portion on the tape main body side of the upper direction converting portion are provided using the upper fixing warp thread. According to this, the invention having the above-described configuration is completed.

That is, according to the woven fastener stringer of the invention, in the element attaching portion of the fastener tape, the upper extension portion composed of the upper fixing warp thread and the lower extension portion composed of the lower fixing warp thread are placed to sandwich the fastener element. According to this, since the element attaching portion is widened toward the engaging head portion, when the slide fastener is used in the inside out manner, it is possible to hide the coupled left and right fastener elements by the fastener tape and to make it difficult to see the fastener elements.

Furthermore, it is possible to keep balance among a fastening force applied to the engaging head portion of the fastener element by the upper fixing warp thread, a fastening force applied to the engaging head portion of the fastener element by the lower fixing warp thread, and a tensile force of the weft thread which is twined with them. Therefore, it is possible to prevent the threads of the lower extension portion from being superposed on each other. According to this, it is possible to avoid a case where excessive contact with the lower extension portion is caused by sliding motion of the slider when the slide fastener opens and closes.

Further, according to the woven fastener stringer of the invention, the upper extension portion is provided on the side of the tape main body of the upper direction converting portion using the upper fixing warp thread. Therefore, not only when the slide fastener is used in the inside out manner, but also when the slide fastener is used in the normal face up manner, it is possible to more widely hide the coupled left and right fastener elements so that it is difficult to see the fastener element than the conventional slide fasteners using a constituent thread of the fastener tape.

In the woven fastener stringer of the invention, the plurality of upper and lower fastening warp threads are located on the upper and lower extension portions respectively. Therefore, if the slide fastener is configured and used in the inside out manner or if the slide fastener is used in the normal face up manner, it is possible to more widely hide the coupled left and right fastener elements by the fastener tape, and to make it more difficult to see the fastener elements.

In addition, in the woven fastener stringer of the invention, the element attaching portion includes the restricting warp thread which runs in the warp direction while alternately interlacing with the weft thread which runs along the upper leg and the weft thread which runs along the lower leg, and which restricts positions of the upper and lower fixing warp threads in the weft direction. According to this, it is possible to restrict and stabilize positions of the upper and lower fixing warp threads and the fastening warp thread, and it is possible to prevent the positions of the warp threads from deviating, and to prevent the warp threads from being superposed on each other. Further, since the restricting warp thread alternately interlaces with the weft thread on the side of the upper leg and the weft thread on the side of the lower leg, it is possible to prevent the weft threads from loosening. According to this, it is possible to stabilize the woven texture of the element attaching portion, and it is possible to maintain, for a long time, the concealed state and the coupled strength of the fastener elements in the woven slide fastener.

In this case, in the woven fastener stringer of the invention, the weft thread includes the vertically running portion which runs in a tape front/back direction between the upper direction converting portion composed of the upper fixing warp thread and the lower direction converting portion composed of the lower fixing warp thread. The upper extension portion is placed between the vertically running portion of the weft thread and the restricting warp thread. The lower extension portion is placed between adjacent two restricting warp threads. According to this, positions of the upper extension portion and the lower extension portion are reliably restricted. Therefore, when the slide fastener is configured and the left and right fastener elements are coupled to each other, both the upper leg and the lower leg of the fastener element can reliably be hidden by the fastener tape.

Further, according to the woven fastener stringer of the invention, the total number of upper fixing warp threads placed on the upper direction converting portion and the upper extension portion, and the total number of lower fixing warp threads placed on the lower direction converting portion and the lower extension portion are the same. According to this, it is possible to stably keep the balance among the fastening force applied to the fastener element by the upper fixing warp thread, the fastening force applied to the fastener element by the lower fixing warp thread, and the tensile force of the weft thread which are twined with them, and it is possible to more effectively make it difficult to see the engaging head portion of the fastener element.

Since the slide fastener provided by the invention includes the pair of left and right woven fastener stringers having the above-described configuration, when the slide fastener is used in the inside out manner, it is possible to hide the coupled left and right fastener elements by the fastener tape so that it is difficult to see the fastener elements. Even if the slide fastener is used in the normal face up manner, it is possible to widely hide the coupled left and right fastener elements by the constituent thread of the fastener tape so that it is difficult to see the fastener elements. Furthermore, according to the slide fastener of the invention, since the engaging head portion of the fastener element is stably held in a state where the engaging head portion substantially stands upright with respect to the tape surface, it is possible to smoothly couple and separate the left and right fastener elements to and from each other by sliding the slider.

DESCRIPTION OF EMBODIMENTS

A preferred embodiment of the invention will be described in detail with reference to the drawings. The invention is not limited to the embodiment which will be described below, and if substantially the same configuration as that of the invention can be provided and the same working effects can be exerted, the invention can variously be modified.

For example, in a woven fastener stringer described in the following embodiment, a continuous element row which is woven into and fixed to a fastener tape is configured by molding a monofilament into a coil-shape, but the invention is not limited to this, and the continuous element row may be configured by molding the monofilament into a zigzag-shape.

Material and fineness (thickness of thread and the number of threads) of each constituent thread which configures the fastener tape are not especially limited, the same material and fineness as a generally used constituent thread in the conventional woven fastener stringer can be employed, and material and fineness of the constituent thread may freely be changed if need arises.

Figure 1:
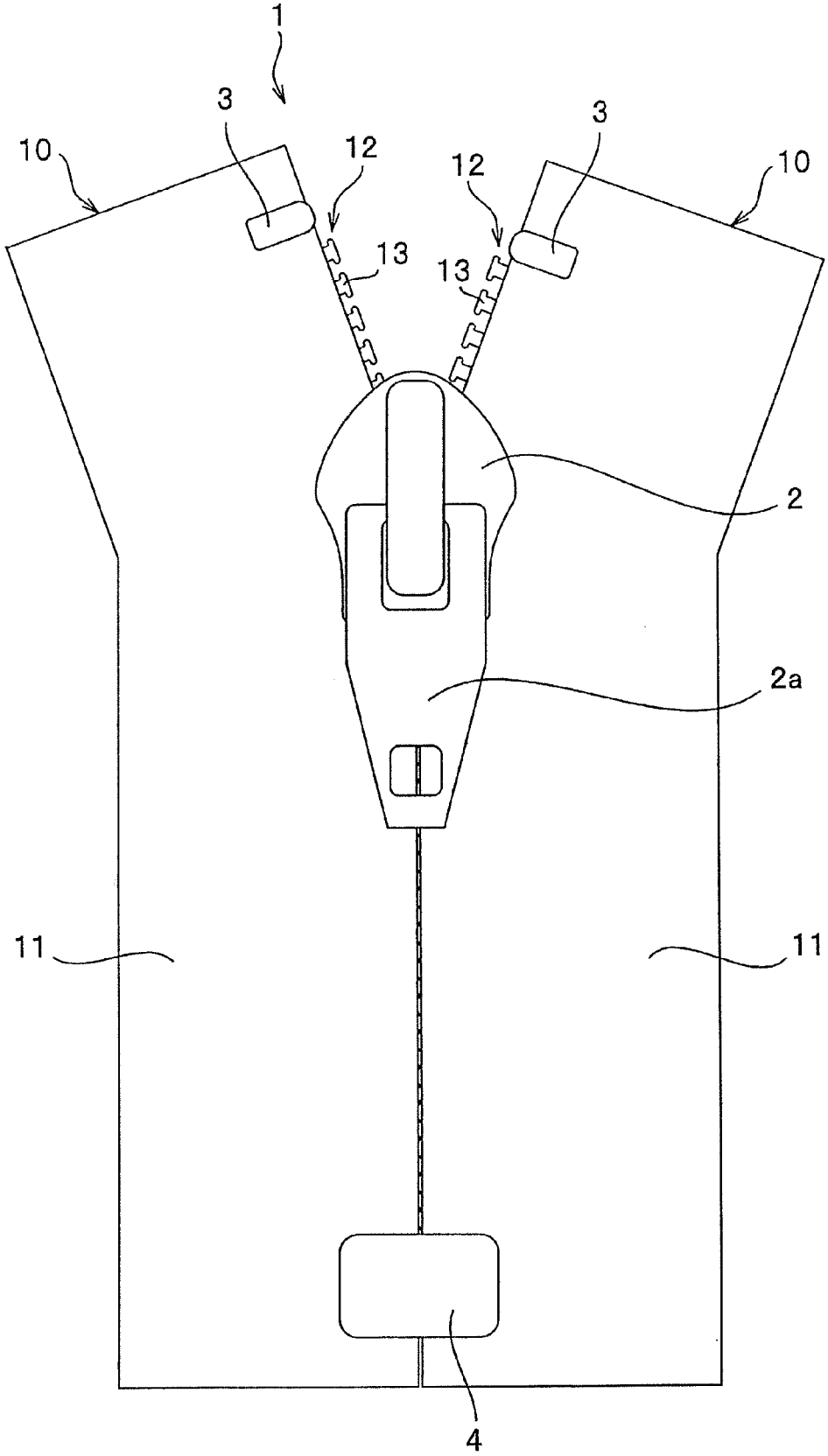
FIG. 1 is a schematic diagram of a slide fastener according to an embodiment of the invention as viewed from its outer surface when the slide fastener is used in an inside out manner.
Figure 2:
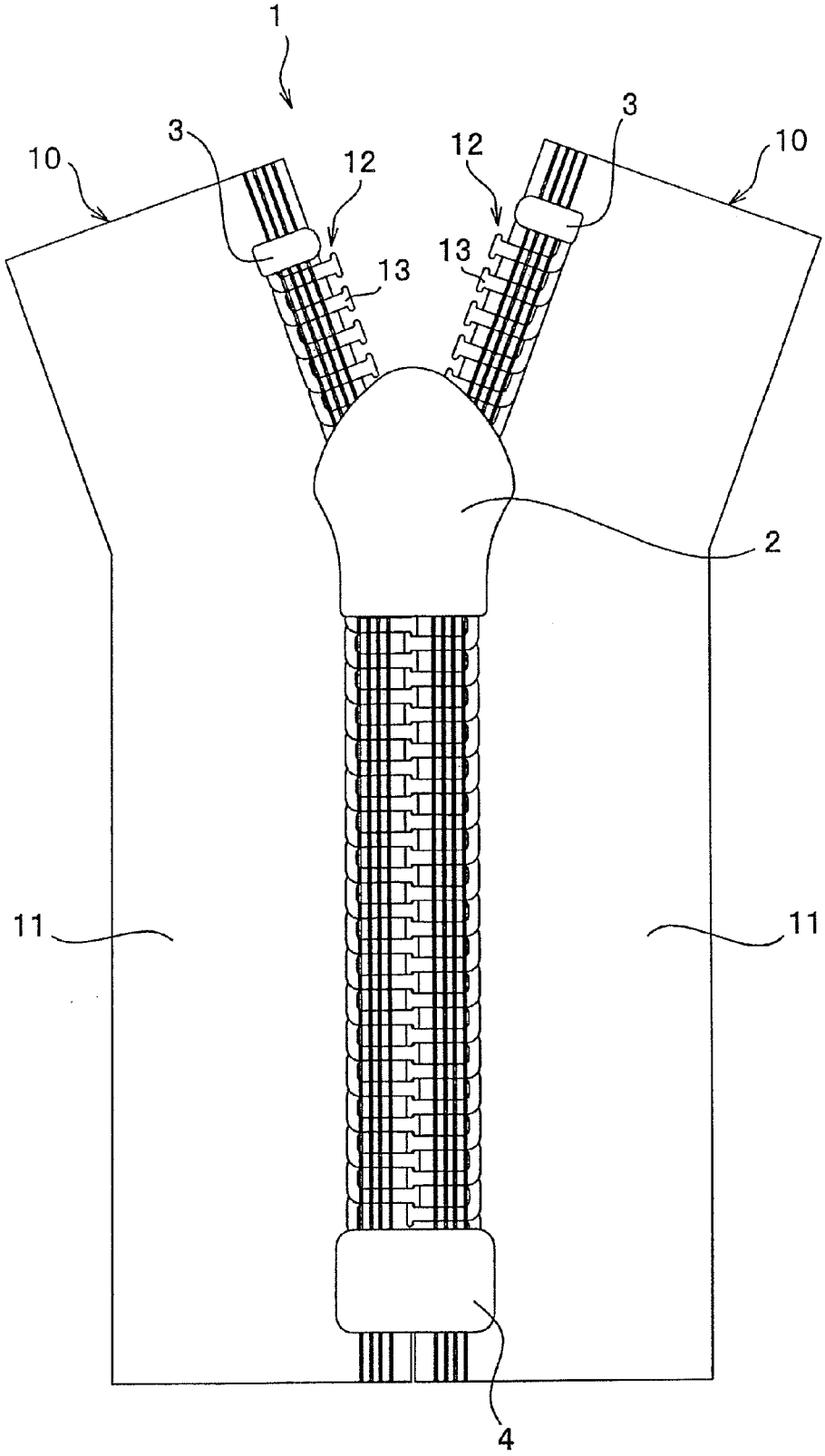
FIG. 2 is a schematic diagram of the slide fastener as viewed from its inner surface.
Figure 3:
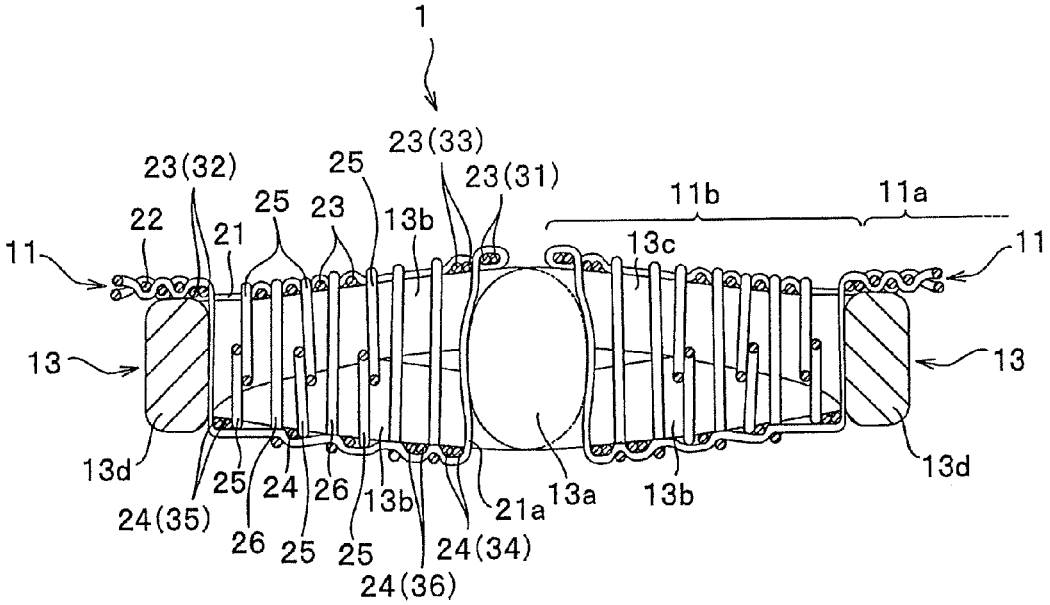
FIG. 3 is a sectional view of the slide fastener.

FIG. 1 is a schematic diagram of a slide fastener according to the embodiment as viewed from its outer surface when the slide fastener is used in an inside out manner, FIG. 2 is a schematic diagram of the slide fastener as viewed from its inner surface. FIG. 3 is a sectional view of the slide fastener.

In these drawings, to facilitate understanding of the invention, weft threads and various kinds of warp threads are illustrated relatively thinly, and a weaving structure (woven texture) is illustrated roughly. In reality, however, the various kinds of weft threads and warp threads having necessary thickness are used and the woven texture is also configured in minute while taking a function as a fastener stringer into consideration.

In the drawings, vertical directions of a lower fixing warp thread 23 and an upper fixing warp thread 24 do not match with vertical directions of planes of paper, a side closer to an element attaching portion 11*b* and a tape main body 11*a* with respect to a fastener element 13 is determined as a lower side, and a side opposite from the former side is determined as an upper side.

The slide fastener 1 according to the embodiment includes a pair of woven fastener stringers 10 comprising continuous element rows 12 on facing tape side edges of left and right fastener tapes 11, a slider 2 which is placed such that the slider 2 can slide along the continuous element rows 12 and which has a stopping mechanism, first stops 3 which are placed in adjacent to the continuous element rows 12 on front ends of the fastener stringers 10, and a second stop 4 which straddles rear ends of the left and right fastener stringers 10 and which is placed in adjacent to the continuous element rows 12.

The slide fastener 1 of the embodiment is characterized in the woven texture of the element attaching portions 11*b* of the fastener tapes 11, which will be described later. The slider 2, the first stops 3 and the second stop 4 configuring the slide fastener 1 of the embodiment have substantially the same configurations as those of a slider having a stopping mechanism, first stops and a second stop which are generally used in a conventional slide fastener used in the inside out manner and therefore, detailed description of these members will be omitted.

Each of the woven fastener stringers 10 in the embodiment includes the woven fastener tape 11 and the coil-shaped continuous element row 12 which is woven into the fastener tape 11. Each of the fastener tapes 11 includes the tape main body 11*a* and the element attaching portion (tape side edge) 11*b* which is formed on the one side edge of the tape main body 11*a* and into which the continuous element row 12 is woven.

Each of the continuous element rows 12 is configured such that by forming synthetic resin monofilament into a coil shape, a large number of fastener elements 13 are continuous in a length direction of a tape. The continuous element row 12 includes an engaging head portion 13*a*, an upper leg 13*b* and a lower leg 13*c* which are placed such that they extend from the engaging head portion 13*a* in a width direction of the tape, and a connecting portion 13*d* which connects the upper leg 13*b* of the fastener element 13 and the lower leg 13*c* of the next adjacent fastener element 13. In this case, the lower leg 13*c* is a leg on a side which is in intimate contact with a tape surface of the fastener tape 11, and the upper leg 13*b* is a leg on a side which is separated from the tape surface of the fastener tape 11.

The continuous element row 12 of the embodiment is fixed by weaving the upper and lower legs 13*b* and 13*c* into the element attaching portion 11*b* simultaneously when the fastener tape 11 is woven such that the engaging head portion 13*a* of the fastener element 13 projects outward from the tape side edge of the fastener tape 11 on the side of the element attaching portion 11*b*.

Figure 5:
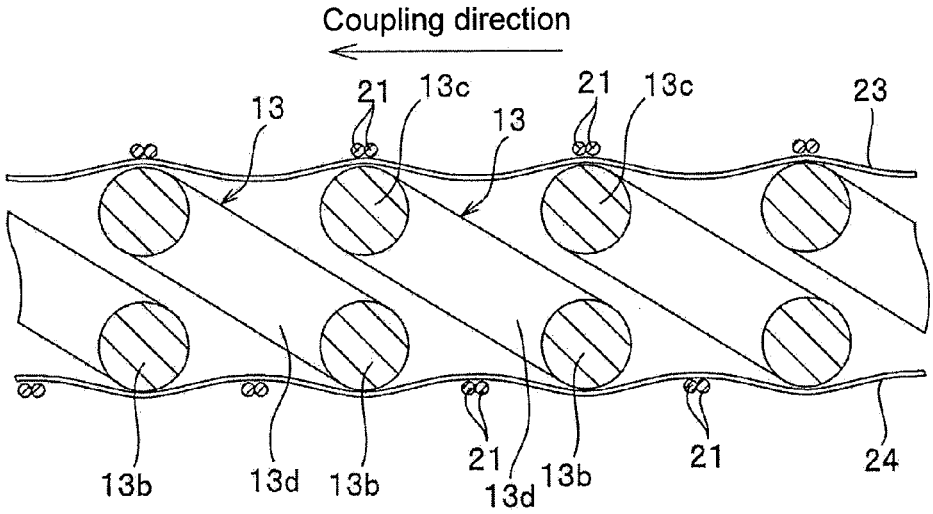
FIG. 5 is a schematic diagram illustrating a relation between the weft thread and the upper and lower fixing warp threads with respect to a fastener element in an element attaching portion.

In this case, as shown in FIG. 5, each of the connecting portions 13*d* of the continuous element row 12 is placed such that the connecting portion 13*d* inclines downward in a direction opposite from a direction (hereinafter, referred to as coupling direction) in which the slider 2 slides to couple the left and right fastener elements 13 to each other.

Figure 4:
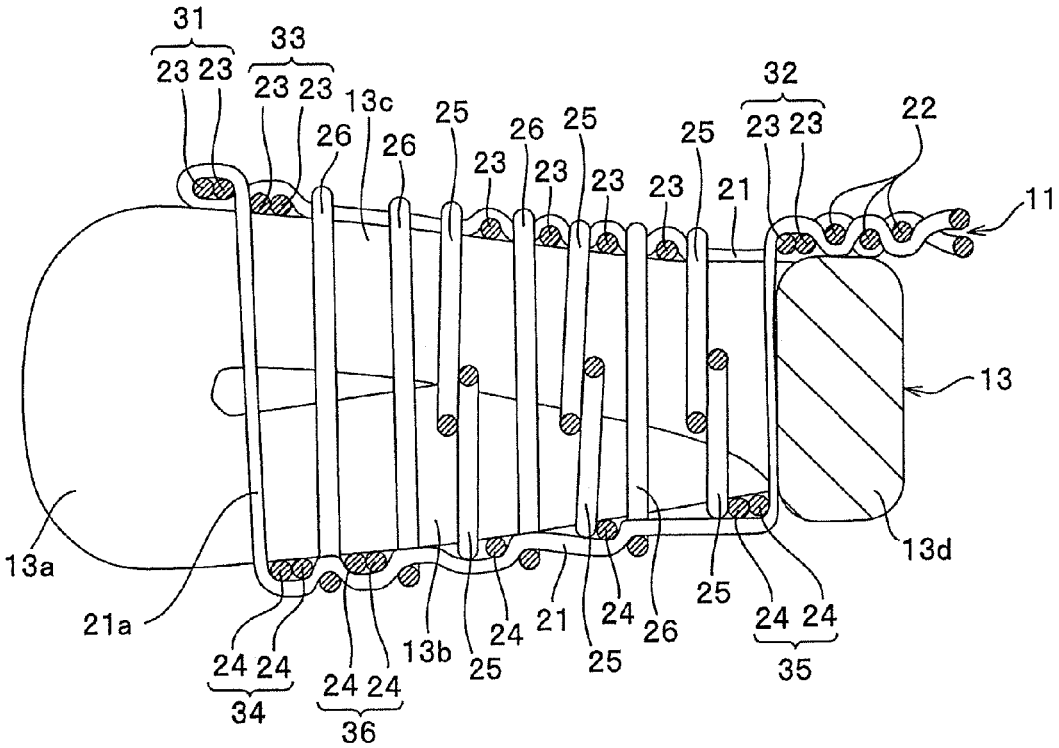
FIG. 4 is a sectional view of a portion of one of fastener stringers in the slide fastener.

As shown in FIGS. 3 and 4, the woven texture of the fastener tape 11 in the embodiment is formed by reciprocating a carrier bar and inserting the weft thread into each warp thread, the tape main body 11*a* of the fastener tape 11 is woven by the weft thread 21 and the ground warp thread 22 composed of two threads.

An ear portion (not shown) is formed on an end of the tape main body 11*a* on a side opposite from a side on which the element attaching portion 11*b* is formed. The ear portion is formed by sequentially catching the next weft thread 21 and connecting a folded back end of a loop.

The element attaching portion 11*b* of the fastener tape 11 is composed of the weft thread 21 which is continuously weft-inserted from the tape main body 11*a* and which runs along the upper and lower legs 13*b* and 13*c* of each of the fastener elements 13, the ten lower fixing warp threads 23 which run on the side of a lower surface of the lower leg 13*c* of each of the fastener elements 13 in the warp direction, the eight upper fixing warp threads 24 which run on the side of the upper surface of the upper leg 13*b* of each of the fastener elements 13 in the warp direction, the six fastening warp threads 25 which run in the warp direction while alternately straddling the upper leg 13*b* and the lower leg 13*c* in the continuous element row 12, and the four restricting warp threads 26 which run in the warp direction while alternately interlacing with the weft thread 21 which runs along the upper leg 13*b* and the lower leg 13*c*.

The weft thread 21 placed in the element attaching portion 11*b* is weft-inserted such that the weft thread 21 runs in the following direction or in the opposite direction. That is, the weft thread 21 runs in the weft direction on the side of lower surfaces of the plurality of lower fixing warp threads 23 from the tape main body 11*a* along the lower leg 13*c* at a position where the upper and lower legs 13*b* and 13*c* are located in the warp direction, the weft thread 21 is reversed to run around a first lower direction converting portion 31 formed by the two lower fixing warp threads 23 placed on the side of the engaging head portion 13*a*, and a running direction of the weft thread 21 is converted in the front/back direction.

Next, the weft thread 21 runs in the front/back direction of the tape from the first lower direction converting portion 31 toward the upper leg 13*b* and at the same time, the weft thread 21 moves in the warp direction by a distance corresponding to one-half of a gap (pitch) formed between the fastener elements 13, the weft thread 21 is folded at a first upper direction converting portion 34 which is formed by the two upper fixing warp threads 24 placed on the side of the engaging head portion 13*a*, and a running direction of the weft thread 21 is converted into the weft direction along the upper leg 13*b*.

The weft thread 21 runs in the weft direction along the upper leg 13*b* on the side of the upper surfaces of the plurality of upper fixing warp threads 24 at a position between the fastener elements 13 in the warp direction, the weft thread 21 is folded in the tape front/back direction at a second upper direction converting portion 35 formed by the two upper fixing warp threads 24 placed on the side of the connecting portion 13*d*, the weft thread 21 runs in the tape front/back direction from the second upper direction converting portion 35 toward the lower leg 13*c*, and the weft thread 21 is folded toward the tape main body 11*a* at a second lower direction converting portion 32 formed by the two lower fixing warp threads 23 placed on the side of the connecting portion 13*d*. According to this, the weft thread 21 is returned to the tape main body 11*a*.

The weft thread 21 is weft-inserted into the element attaching portion 11*b* in the above-described manner. According to this, the upper and lower legs 13*b* and 13*c* of the fastener element 13 are woven such that the upper and lower legs 13*b* and 13*c* are sandwiched through the upper fixing warp thread 24 and the lower fixing warp thread 23, and the upper and lower legs 13*b* and 13*c* are strongly fixed to the element attaching portion 11*b*.

The lower fixing warp thread 23 is placed such that it is substantially flush with the woven texture of the tape main body 11*a* when the fastener tape 11 is woven. Four lower fixing warp threads 23 are placed in a region closer to the engaging head portion 13*a* than one of the six fastening warp threads 25 which is placed closest to the engaging head portion 13*a*. The first lower direction converting portion 31 which reverses the weft thread 21 at the side of the engaging head portion 13*a* and converts the running direction of the weft thread 21 is configured by the two of the four lower fixing warp thread 23 which are placed closer to the engaging head portion 13*a*.

The two lower fixing warp threads 23 placed in adjacent to this first lower direction converting portion 31 configure a lower extension portion 33 which extends the element attaching portion 11*b* toward the engaging head portion 13*a*. Since the lower extension portion 33 is provided in the element attaching portion 11*b* of the fastener tape 11, the element attaching portion 11*b* can be formed long toward the engaging head portion 13*a*.

Hence, it is possible to hide the coupled left and right continuous element rows 12 by the element attaching portion 11*b* of the fastener tape 11 so that they cannot easily be seen when they are viewed from the outer surface side (that is, from a tape surface side which is opposite from a tape surface side where the continuous element row 12 is placed) in a state where the slide fastener 1 of the embodiment is closed (see FIG. 1). Here, the lower extension portion 33 is placed closer to the engaging head portion 13*a* than the restricting warp thread 26, the lower extension portion 33 is located between the restricting warp thread 26 and the first lower direction converting portion 31, and a position of the first lower direction converting portion 31 can be brought further closer to the engaging head portion 13*a*.

In this case, it is possible to further widen the element attaching portion 11*b* toward the engaging head portion 13*a* by increasing the number of lower fixing warp threads 23 which configure the lower extension portion 33 as will be described later. In the case of this embodiment, however, the slider 2 having the stopping mechanism is used in the slide fastener 1. Hence, to stably operate the stopping mechanism in the slider 2, it is necessary to engage a locking pawl (not shown) placed on the side of an upper blade on which a tab 2*a* of the slider 2 is mounted with the coupled fastener elements 13 through a gap between the left and right fastener tapes 11.

Therefore, in the slide fastener 1, an extension length of the element attaching portion 11*b* extended by the lower extension portion 33 is set to a predetermined value corresponding to a size of the fastener element 13 so that the gap through which the locking pawl of the slider 2 can pass is formed between the left and right fastener tapes 11 when the left and right continuous element rows 12 are coupled to each other.

The two lower fixing warp threads 23 are placed in a region closer to the connecting portion 13*d* than one of the six fastening warp threads 25 which is closest to the connecting portion 13*d*. These two lower fixing warp threads 23 configure the second lower direction converting portion 32 which folds the weft thread 21 toward the connecting portion 13*d* and converts the running direction of the weft thread 21. The four lower fixing warp threads 23 are placed at predetermined positions between the lower extension portion 33 and the second lower direction converting portion 32 so that the continuous element row 12 can stably be held.

As shown in FIG. 5, the upper fixing warp thread 24 is placed such that it runs in the warp direction between the upper leg 13*b* of the fastener element 13 and the weft thread 21 which runs along the upper leg 13*b*. The four upper fixing warp threads 24 are placed in a region closer to the engaging head portion 13*a* than one of the six fastening warp threads 25 which is placed closest to the engaging head portion 13*a*. Two of the four upper fixing warp threads 24 which are close to the engaging head portion 13*a* configure the first upper direction converting portion 34 which folds the weft thread 21 substantially 90° at the side of the engaging head portion 13*a* to convert the running direction of the weft thread 21.

The two upper fixing warp threads 24 placed in adjacent to the first upper direction converting portion 34 configure an upper extension portion 36 which extends the element attaching portion 11*b* toward the engaging head portion 13*a*. Since such a upper extension portion 36 is provided on the element attaching portion 11*b* of the fastener tape 11, it is possible to widely hide the coupled left and right continuous element rows 12 so that they cannot easily be seen when they are viewed from an inner surface (that is, from tape surface side where the continuous element row 12 is placed) in a state where the slide fastener 1 of the embodiment is closed. Here, the upper extension portion 36 is placed closer to the engaging head portion 13*a* than the restricting warp thread 26, the upper extension portion 36 is located between the two adjacent restricting warp threads 26 on the side of the tape main body 11*a* of the first upper direction converting portion 34, and a position of the first upper direction converting portion 34 can be brought further closer to the engaging head portion 13*a*.

The two upper fixing warp threads 24 are placed in a region closer to the connecting portion 13*d* than one of the six fastening warp threads 25 which is closest to the connecting portion 13*d*. These two upper fixing warp threads 24 configure the second upper direction converting portion 35 which folds the weft thread 21 at the side of the connecting portion 13*d* to convert the running direction of the weft thread 21. The two upper fixing warp threads 24 are located at predetermined positions between the upper extension portion 36 and the second upper direction converting portion 35 so that the continuous element row 12 can stably be fixed.

Especially in this embodiment, all of the first and second upper direction converting portions 34 and 35 and the first and second lower direction converting portions 31 and 32 are configured by the two upper fixing warp threads 24 or the two lower fixing warp threads 23. According to this, it is possible to enhance the strength of the end of the element attaching portion 11*b*, and even if a large load is applied to the first and second upper direction converting portions 34 and 35 or the first and second lower direction converting portions 31 and 32 by the weft thread 21, it is possible to prevent the direction converting portions 31, 32, 34 and 35 from becoming fuzzy and to prevent the upper and lower fixing warp threads 24 and 23 from easily being cut.

In this case, according to the woven fastener stringer 10 of this embodiment, the total number of lower fixing warp threads 23 placed in the first and second lower direction converting portions 31 and 32 and the lower extension portion 33, and the total number of upper fixing warp threads 24 placed in the first and second upper direction converting portions 34 and 35 and the upper extension portion 36 are set to the same values.

For example, when the continuous element row 12 is attached to the fastener tape 11 in a state where the connecting portion 13*d* downwardly inclines in the coupling direction as described above, if a force balance among the fastening force applied by the upper fixing warp thread 24, the fastening force applied by the lower fixing warp thread 23 and the tensile force of the weft thread which is twined with them becomes unstable, the lower fixing warp thread 23 configuring the lower extension portion 33 easily moves toward the tape main body 11*a* or the lower fixing warp threads 23 are easily superposed on each other. As a result, it becomes difficult to stably hide the engaging head portion 13*a* of the fastener element 13 by the element attaching portion 11*b*.

However, if the total number of lower fixing warp threads 23 placed in the first and second lower direction converting portions 31 and 32 and the lower extension portion 33, and the total number of upper fixing warp threads 24 placed in the first and second upper direction converting portions 34 and 35 and the upper extension portion 36 are the same as in this embodiment, it is possible to stably maintain the balance among the fastening force applied to the fastener element 13 by the upper fixing warp thread 24, the fastening force applied by the lower fixing warp thread 23 and the tensile force of the weft thread 21 which is twined with them, and it is possible to stably exert the effect to make it difficult to see the engaging head portion 13*a* by the element attaching portion 11*b*.

Figure 6:
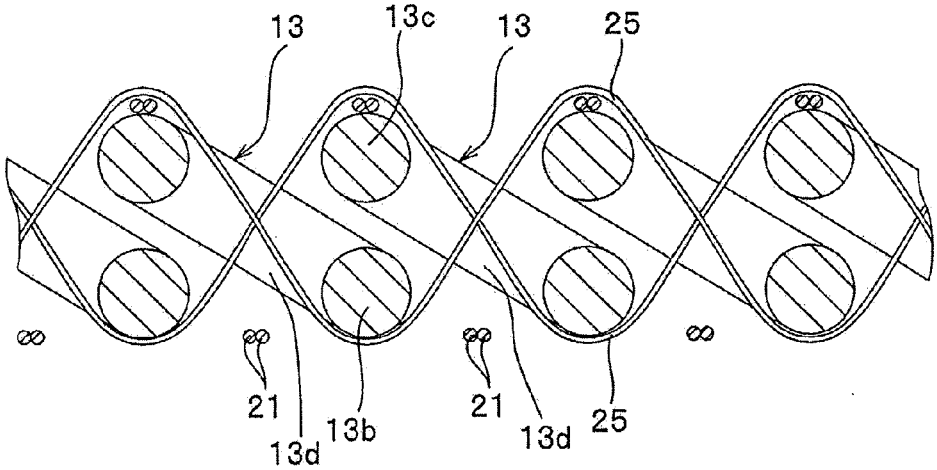
FIG. 6 is a schematic diagram illustrating a relation between the weft thread and the fastening warp thread with respect to the fastener element in the element attaching portion.

As shown in FIG. 6, the fastening warp thread 25 is placed such that it runs in the warp direction while alternately interlacing with the upper leg 13*b* of the fastener element 13, and with the lower leg 13*c* of the fastener element 13 and the weft thread 21 which runs along the lower leg 13*c*. In this embodiment, three sets of two adjacent fastening warp threads 25 whose running directions are symmetric in the tape front/back direction are placed at a predetermined gap between them in the weft direction.

The total six fastening warp threads 25 are placed in accordance with the above-described relation. Therefore, it is possible to strongly weave the continuous element row 12 into the element attaching portion 11*b*, and it is possible to stabilize a pitch between the fastener elements 13 of the woven continuous element row 12.

Figure 7:
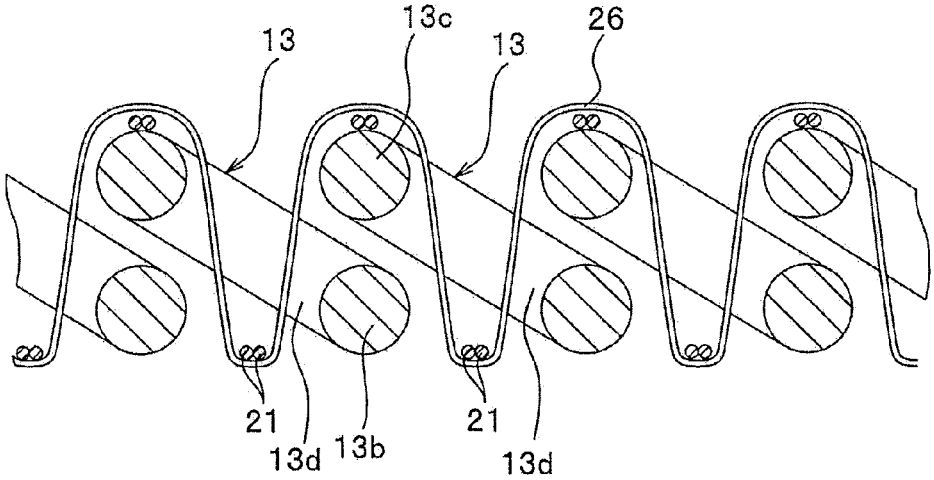
FIG. 7 is a schematic diagram illustrating a relation between the weft thread and the restricting warp thread with respect to the fastener element in the element attaching portion.

As shown in FIG. 7, the restricting warp thread 26 is placed such that it runs in the warp direction while alternately interlacing with the weft thread 21 which runs along the upper leg 13*b* of the fastener element 13 and with the weft thread 21 which runs along the lower leg 13*c* of the fastener element 13. The four restricting warp threads 26 are placed in the element attaching portion 11*b* of this embodiment. According to this, it is possible to prevent the weft thread 21 from loosening, and to more stably fix the continuous element row 12 to the element attaching portion 11*b*.

Two of these four restricting warp threads 26 are placed in a region closer to the engaging head portion 13*a* than one of the fastening warp threads 25 which is closest to the engaging head portion 13*a*, and these two restricting warp threads 26 restrict a position of the lower fixing warp thread 23 in the weft direction which configures the lower extension portion 33 and a position of the upper fixing warp thread 24 in the weft direction which configures the first upper direction converting portion 34 and the upper extension portion 36. That is, the first upper direction converting portion 34 is placed between the vertically running portion 21*a* of the weft thread 21 and one of the restricting warp threads 26 which is closest to the engaging head portion 13*a*. The two restricting warp threads 26 are adjacent to each other, and the upper fixing warp thread 24 which configures the upper extension portion 36 is placed between the two adjacent restricting warp threads 26.

Especially, the two lower fixing warp threads 23 which configure the lower extension portion 33 and the two upper fixing warp threads 24 which configure the first upper direction converting portion 34 are placed between the vertically running portion 21*a* of the weft thread 21 which runs in the tape front/back direction between the first lower direction converting portion 31 and the first upper direction converting portion 34, and one of the restricting warp threads 26 which is placed closest to the engaging head portion 13*a*. The two upper fixing warp threads 24 which configure the upper extension portion 36 are placed between the two restricting warp threads 26 which are placed close to the engaging head portion 13*a*.

This configuration prevents positions of the lower fixing warp threads 23 which configure the lower extension portion 33, and positions of the upper fixing warp threads 24 which configure the first upper direction converting portion 34 and the upper extension portion 36 from deviating in the weft direction, and prevents the lower fixing warp threads 23 from being vertically superposed on each other and the upper fixing warp threads 24 from being vertically superposed on each other, and it is possible to stabilize the woven texture of the element attaching portion 11*b*.

Since the positions of the lower fixing warp threads 23 and the upper fixing warp threads 24 are restricted using the restricting warp threads 26 instead of the fastening warp threads 25, it is possible to weaken the forces for fastening the upper and lower legs 13*b* and 13*c* of the fastener element 13 as compared with a case where these positions are restricted by the fastening warp threads 25.

According to this, in the element attaching portion 11*b*, it is possible to prevent a force for fixing portions of the upper and lower legs 13*b* and 13*c* on the side of the engaging head portion 13*a* from becoming excessively strong. Therefore, movements of the fastener elements 13 are permitted to some extent, and it is possible to secure flexibility of the fastener elements 13. As a result, when the left and right continuous element rows 12 are coupled to each other by sliding the slider 2, since it becomes easy to couple the left and right fastener elements 13 to each other, it is possible to enhance the sliding performance and operability of the slider 2.

In the element attaching portion 11*b* of the embodiment, the positions of the two lower fixing warp threads 23 which configure the first lower direction converting portion 31 are restricted by the vertically running portion 21*a* of the weft thread 21. According to this, positions of the lower fixing warp threads 23 are prevented from deviating in the weft direction toward the connecting portion 13*d*, and the lower fixing warp threads 23 are prevented from being vertically superposed on each other.

According to the slide fastener 1 of the embodiment having the above-described configuration, the attitude of the engaging head portion 13*a* standing upright with respect to the tape surface of the fastener tape 11 is maintained, and the continuous element row 12 is stably woven into the element attaching portion 11*b* simultaneously when the fastener tape 11 is woven. Hence, by sliding the slider 2 along the left and right continuous element rows 12, it is possible to smoothly couple and separate the left and right fastener elements 13 to and from each other, and it is possible to stably secure excellent sliding performance and operability of the slider 2.

According to the slide fastener 1, the lower extension portion 33 configured by the two lower fixing warp threads is placed in adjacent to the first lower direction converting portion 31, and the upper extension portion 36 configured by the two upper fixing warp threads is placed in adjacent to the first upper direction converting portion 34. According to this, the element attaching portion 11*b* of the fastener tape 11 is widened toward the engaging head portion 13*a* of the fastener element 13 as compared with the conventional woven slide fastener as described in Patent Document 1, for example.

Hence, when the slide fastener 1 of the embodiment is viewed from the tape surface which is opposite from the tape surface where the continuous element row 12 is placed as shown in FIG. 1, it is possible to hide the coupled left and right continuous element rows 12 by the element attaching portion 11*b* of the fastener tape 11 so that the continuous element rows 12 cannot easily be seen. Even when the slide fastener 1 is viewed from the tape surface where the continuous element row 12 is placed as shown in FIG. 2, it is possible to widely hide the coupled left and right continuous element rows 12 so that the continuous element rows 12 cannot easily be seen.

The weft thread 21 is twined with the various kinds of warp threads of the element attaching portion 11*b* (that is, lower fixing warp thread 23, upper fixing warp thread 24, fastening warp thread 25 and restricting warp thread 26). Therefore, even when a lateral pulling force for pulling the left and right woven fastener stringers 10 to separate them from each other in the tape width direction is applied, the positions of the weft thread 21 and the various kinds of warp threads are not deviated, and it is possible to stably maintain the state where the continuous element rows 12 cannot easily be seen.

Figure 8:
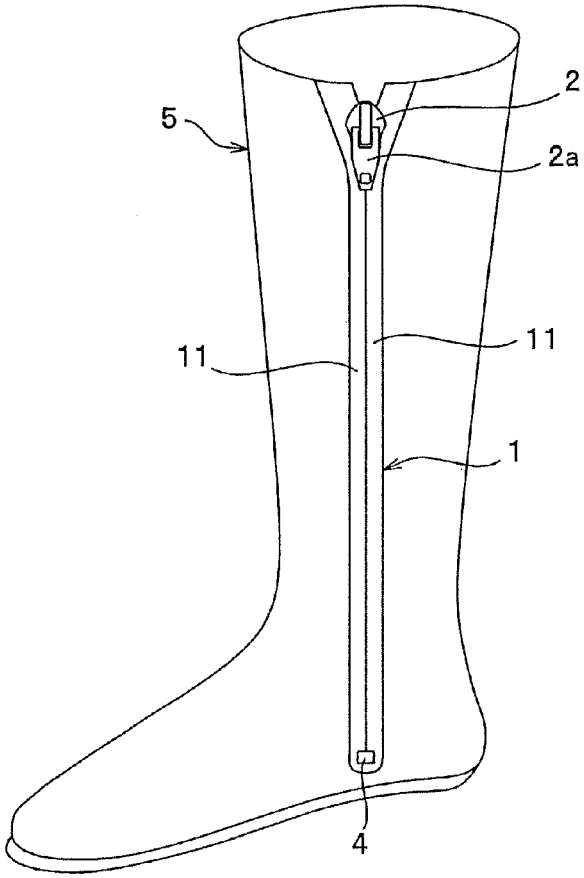
FIG. 8 is a perspective view showing a usage example of the slide fastener.

As shown in FIG. 8, for example, the slide fastener 1 of the embodiment is attached to an opening of a boot 5 in the inside out manner by sewing or the like so that a user can easily wear and take off the boot 5.

According to the boot 5 to which the slide fastener 1 of the embodiment is attached, when the slide fastener 1 is closed, the coupled left and right continuous element rows 12 are hidden by the fastener tape 11 so that it is difficult or impossible to see the continuous element rows 12. Therefore, it is possible to prevent the design and the presentation of the boot 5 from being deteriorated by the slide fastener 1. The slide fastener 1 of the embodiment can also be attached to the opening of the boot 5 in a face up manner naturally.

According to this slide fastener 1, the lower extension portion 33 and the upper extension portion 36 of the element attaching portion 11*b* are respectively composed of the two lower fixing warp threads and the two upper fixing warp threads as described above. However, in the invention, the number of the lower fixing warp threads configuring the lower extension portion 33 and the number of upper fixing warp threads configuring the upper extension portion 36 are not especially limited, and the number may be one or three or more. The number of lower fixing warp threads configuring the first lower direction converting portion 31 and the number of upper fixing warp threads configuring the first upper direction converting portion 34 can also be changed freely.

Figure 9:
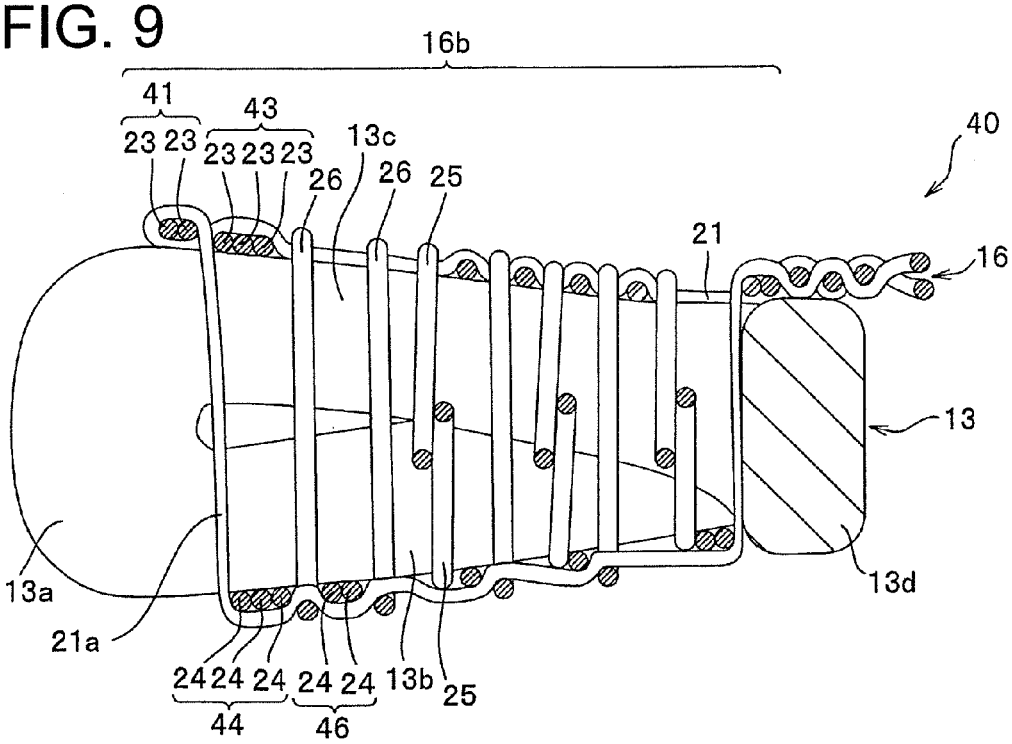
FIG. 9 is a sectional view illustrating a portion of a fastener stringer according to a modification of the invention.
Figure 10:
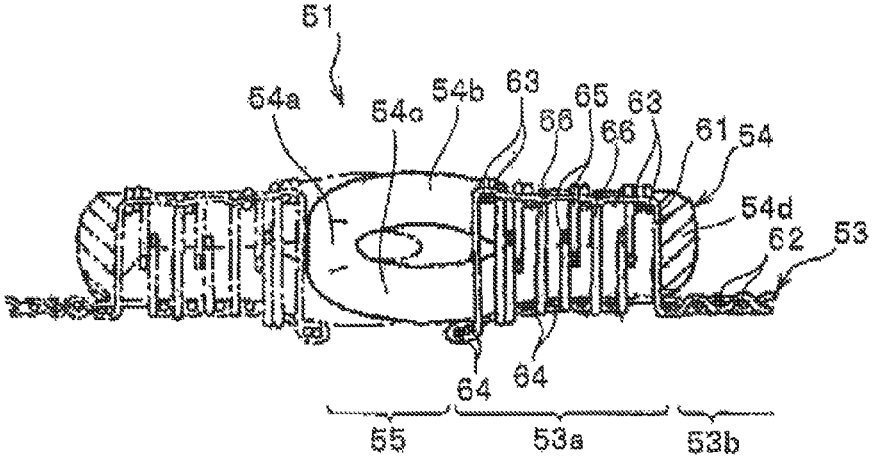
FIG. 10 PRIOR ART
FIG. 10 is a sectional view illustrating a conventional woven fastener stringer.
Figure 11:
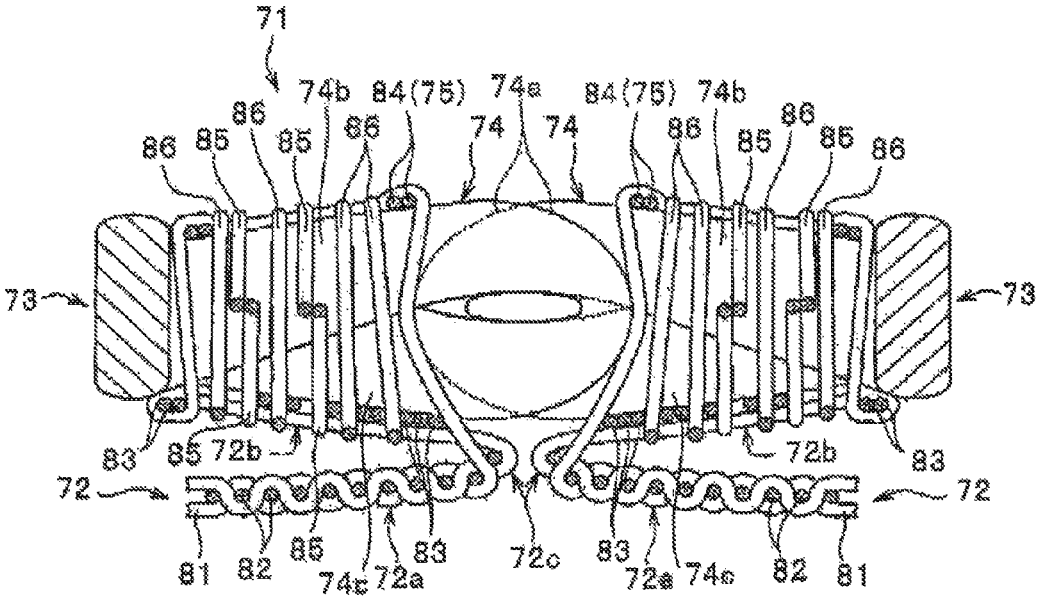
FIG. 11 PRIOR ART
FIG. 11 is a sectional view illustrating a hidden slide fastener using the conventional woven fastener stringer.

For example, when the slide fastener is configured using a slider having no stopping mechanism or when a size of the fastener element is large, a lower extension portion 43 which is placed in adjacent to a first lower direction converting portion 41 can be formed from three lower fixing warp threads 23 to configure a woven fastener stringer 40 as shown in FIG. 9.

According to this, it is possible to extend an element attaching portion 16*b* of a fastener tape 16 to a location closer to the engaging head portion 13*a* than the slide fastener 1 of the above-described embodiment. According to this, when the slide fastener is used in the inside out manner, it is possible to more reliably and stably hide the coupled left and right continuous element rows 12 by the element attaching portion 16*b* of the fastener tape 16.

In this case, to keep a balance between the fastening force applied by the upper fixing warp thread 24 and the fastening force applied by the lower fixing warp thread 23 on the side of the engaging head portion 13*a* of the fastener element 13, it is preferable that the total number of upper fixing warp threads 24 placed in a first upper direction converting portion 44 and a upper extension portion 46 matches with the total number of lower fixing warp threads 23 placed in the first lower direction converting portion 41 and the lower extension portion 43.

At this time, as shown in FIG. 9, the number of upper fixing warp threads 24 configuring the first upper direction converting portion 44 can be three, and the number of upper fixing warp threads 24 configuring the upper extension portion 46 instead of the first upper direction converting portion 44 can be three. However, to prevent the restricting warp thread 26 (that is, restricting warp thread 26 placed closest to engaging head portion 13*a*) which restricts the positions of lower fixing warp threads 23 for the lower extension portion 43 and the positions of the upper fixing warp threads 24 for the first upper direction converting portion 44 from running in the warp direction while deviating in the weft direction in a zig-zag manner, it is especially preferable that the number of the upper fixing warp threads 24 for the first upper direction converting portion 44 is set to three in accordance with the number of lower fixing warp threads 23 for the lower extension portion 43.

REFERENCE SIGNS LIST

1 slide fastener
2 slider
2*a* tab
3 first stop
4 second stop
5 boot
10 woven fastener stringer

11 fastener tape
11*a* tape main body
11*b* element attaching portion
12 continuous element row
13 fastener element
13*a* engaging head portion
13*b* upper leg
13*c* lower leg
13*d* connecting portion
16 fastener tape
16*b* element attaching portion
21 weft thread
21*a* vertically running portion
22 ground warp thread
23 lower fixing warp thread
24 upper fixing warp thread
25 fastening warp thread
26 restricting warp thread
31 first lower direction converting portion
32 second lower direction converting portion
33 lower extension portion
34 first upper direction converting portion
35 second upper direction converting portion
36 upper extension portion
40 woven fastener stringer
41 first lower direction converting portion
43 lower extension portion
44 first upper direction converting portion
46 upper extension portion

The invention claimed is:

1. A woven fastener stringer including:

a woven fastener tape having a tape main body and an element attaching portion along one side edge of the tape main body; and a continuous element row woven into and fixed to the element attaching portion along a length direction of the tape, in which each fastener element configuring the continuous element row is woven such that an engaging head portion of the fastener element projects outward from a tape side edge of the fastener tape, the element attaching portion includes a weft thread which is continuously weft-inserted from the tape main body, a plurality of upper fixing warp threads running in a warp direction along an upper surface of an upper leg of the fastener element and a plurality of lower fixing warp threads running in the warp direction along a lower surface of a lower leg of the fastener element, the weft thread interlaces an upper direction converting portion configured by at least a first upper fixing warp thread and a lower direction converting portion configured by at least a first lower fixing warp thread at a location close to the engaging head portion, wherein an upper extension portion configured by at least a second upper fixing warp thread is adjacent to the tape main body side of the upper direction converting portion, and a lower extension portion configured by at least a second lower fixing warp thread is adjacent to the tape main body side of the lower direction converting portion, the element attaching portion includes a plurality of restricting warp threads which run in the warp direction while alternately interlacing with the weft thread as it runs along the upper leg and the weft thread as it runs along the lower leg, and which restrict positions of the upper and lower fixing warp threads in a weft direction, the weft thread includes a vertically running portion which runs in a tape front/back direction between the upper and lower direction converting portions, and the lower extension portion is between the vertically running portion of the weft thread and one of the restricting warp threads, and the upper extension portion is between two adjacent restricting warp threads.

2. The woven fastener stringer according to claim 1, wherein a plurality of the upper fixing warp threads and a plurality of the lower fixing warp threads are placed in the upper and lower extension portions respectively.

3. A slide fastener including a pair of left and right woven fastener stringers according to claim 1.

* * * * *

UNITED STATES PATENT AND TRADEMARK OFFICE

CERTIFICATE OF CORRECTION

PATENT NO. : 9,084,453 B2
APPLICATION NO. : 14/349848
DATED : July 21, 2015
INVENTOR(S) : Yagyu It is certified that error appears in the above-identified patent and that said Letters Patent is hereby corrected as shown below:

In the claims

Column 18, line 1-2, claim 1, after “weft thread” delete “which is continuously”.

Signed and Sealed this
First Day of December, 2015

Michelle K. Lee

Michelle K. Lee
*Director of the United States Patent and Trademark Office*